United States Patent [19]

Porter

[11] Patent Number: 4,678,692

[45] Date of Patent: Jul. 7, 1987

[54] MULTILAYER PROTECTION SYSTEM

[76] Inventor: Julian Porter, 4674 Alvarado Cyn Rd., San Diego, Calif. 92120

[21] Appl. No.: 728,472

[22] Filed: Apr. 29, 1985

[51] Int. Cl.[4] ..... B32B 3/00; B32B 15/04

[52] U.S. Cl. ..... 428/78; 428/384; 428/469; 428/907

[58] Field of Search ..... 428/78, 384, 469, 907

[56] References Cited

U.S. PATENT DOCUMENTS

| | | | |
|---|---|---|---|
| 3,574,030 | 4/1971 | Callander et al. | 428/426 X |
| 3,721,534 | 3/1973 | Kubick | 428/469 X |
| 4,024,295 | 5/1977 | Chase et al. | 427/192 X |
| 4,054,711 | 10/1977 | Botsolas | 428/233 X |
| 4,256,794 | 3/1981 | Meisel | 428/205 X |
| 4,257,549 | 3/1981 | Bricmont | 427/406 X |
| 4,427,716 | 1/1984 | Siwek | 427/383.9 X |
| 4,513,033 | 4/1985 | Patil et al. | 427/383.9 X |
| 4,517,229 | 5/1985 | Nickola et al. | 427/383.9 |
| 4,603,653 | 8/1986 | Bews | 428/907 X |

FOREIGN PATENT DOCUMENTS

| | | | |
|---|---|---|---|
| 58-94459 | 4/1983 | Japan | 428/469 |

*Primary Examiner*—Henry F. Epstein
*Attorney, Agent, or Firm*—Charmasson & Holz

[57] ABSTRACT

A series of protective layers, particularly adapted to application by flame spray processes, provides reliable fouling and corrosion protection against an underwater environment. The construction of the multiple layers provides an underlying galvanic layer and an exposed but intermittent layer providing fouling protection. The two protective layers are electrically insulated by an intervening insulating layer. In the preferred embodiment, the layers are applied by a flame spray process, with partial masking of the final application to provide an intermittent layer. Thickness of layers can be easily varied to provide optimum protection against both fouling and corrosion in a variety of environments.

10 Claims, 2 Drawing Figures

MULTILAYER PROTECTION SYSTEM

FIELD OF THE INVENTION

This invention relates to marine structure protective coatings. It also relates to application of materials by flame spray.

BACKGROUND OF THE INVENTION

The protection of metallic or other structures against an underwater environment is a centuries old art. An underwater structure, typically steel, is subjected to electrochemical corrosion and biological fouling, unless protected, typically by coatings. Coatings have been used instead of using more resistent structural materials to minimize cost.

To be effective, a corrosion protection coating must either totally encompass the structure excluding water contact or be preferentially attacked and consumed. Exclusive-type coatings must also withstand the structural loads and erosive forces of the moving water environment in order to maintain water exclusion integrity. A single breach of the exclusive-type coating to completely prevent water from contacting the underwater structure can lead to accelerated corrosion attack and early failure of the steel structure.

Preferential attack-type coatings must be in electrical contact with the structural material to prevent corrosion. This type of protection is based on the different aqueous electrode potentials or galvanic potential of metals and the current flow which occurs when two dissimilar metals are in electrical contact. Because of the electrochemical nature of corrosion, a more active (or anodic) material will be preferentially attacked (corrosion rate increased) when placed in contact with a more cathode material in water. Because of this preferential attack, a galvanic coating of this type will remain effective even if it does not completely exclude contact between water and structure. Protection lasts until the coating is consumed by the accelerated corrosion. Because of this property, galvanic coatings which fully cover the structure offer double protection by first excluding contact with water until breached, then preferentially being consumed.

Protection against fouling by living waterborne organisms, such as barnacles, is also desirable in underwater structures. Organisms add weight and resistance to water flow, they may also cause biological corrosion. Removal of attached organisms may also damage the structure. The most effective anti-fouling materials or coatings tend to be based on metals more noble or cathodic than steel, such as copper, copper-nickel alloys or tin. These materials appear to act as a poison in nearby water as they corrode. Another anti-fouling technique is to enclose the structure with an ablative material. Still another anti-foulng technique is to completely enclose the steel structure with an extremely smooth surface, which makes it difficult for marine organisms to attach themselves. Thus a smooth copper alloy coating offers multipe protections. The alloy composition and thickness can be varied to achieve maximum protection and the coating does not need to completely enclose the structure to be effective against fouling.

The quest to obtain the maximum protection against both corrosion and fouling has struck against the basic inconsistency of using anodic and cathodic materials to protect the structure. Copper in electrical contact with steel will protect against fouling but will accelerate the steel's corrosion. Alternately, an anodic corrosion protection material, such as aluminum will do little to protect against fouling.

Previous efforts to provide multiple coatings tend to rely on aluminum and/or copper base paints. Thick coatings of these paints are not easily controlled and have difficulty withstanding the erosive water forces. They also tend to be attacked and dry quickly in air, requiring immersion relatively soon after application to be effective. They provide a limited shelf life and generally offer only short term protection. Organic sealers over galvanic coatings offer some fouling protection by exposing a smooth surface difficult for organisms to attach to. But fouling once established, quickly spreads, requiring scraping. Inorganic coatings over galvanic layers again offer some fouling protection by exposing an extremely smooth exterior. However, the erosive forces and particles of moving water soon roughen the inorganic coating allowing fouling to proceed. Other problems with previous multiple layer systems include bonding strength, limited shelf life, and delamination loss due to differential thermal expansion.

SUMMARY OF THE INVENTION

The principal object of this invention is to provide a layered coating which combines both sacrificial fouling and corrosion protection materials for underwater structures in a reliable manner.

It is also an object of this invention to provide a means to confine coating material loss to a small area in the event of coating delamination loss.

It is also an object of this invention to provide reduced shrinkage stress on the layered coating.

A further object of this invention is to allow variable thickness layers to optimize both protections for the application.

These and other useful objects are achieved by bonding a first galvanic coating, such as aluminum, to the structure and to a second layer of coating material which is electrically insulating, such as a ceramic, to which is added an intermittent smooth third layer of biologically toxic material, such as copper. The first and second coatings of variable thickness that enclose the structure to exclude water is a first means of protection against corrosion. The second means of corrosion protection occurs when water is no longer excluded and the galvanic coating is preferentially attacked.

The intermittent nature of the third fouling protection layer minimizes the extent of material loss in the event that the electrically insulating layer is breached. It also eliminates the overall shrinkage stress on the remaining two coating layers and minimize delamination losses.

In the preferred embodiment, the layers are applied by a flame spray process. Coating thickness and properties can be controlled to obtain maximum protection with minimum cost. The intermittent layer pattern can be desigend for maximum protection in the environment. The resulting layered coating provides several types of protection more effective than any single coating or previous multiple layered coating.

DESCRIPTION OF THE PREFERRED EMBODIMENT

Figure 1:
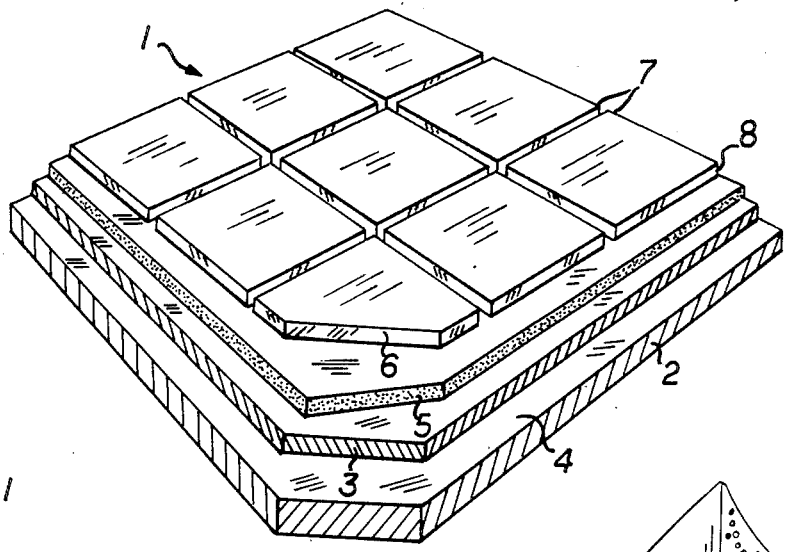
FIG. 1 is a perspective view of a section of structural member cut to expose the various layers of protective coatings.

Referring now to the drawing, FIG. 1 is a section of an underwater structure protected by a multilayer protection coating 1. The figure shows an underlying steel plate structural segment, 2, exposed to water only on the upper portion. A first coating, 3, is composed of aluminum, which is anodic when in contact with the structural steel. Corrosion rates of aluminum in contact with steel are known to be a function of the properties of water (chloride content, PH, and dissolved gases, for example) and the velocity of water. The thickness of the aluminum coating, 3, can therefore be tested and selected to protect the design life of the structure. Typical aluminum coating thickness is 2 to 3 mils, but can be 10 mils or more. The aluminum coating, 3, can be applied to the prepared surface of the structural steel, 2, by a flame spray process in multiple applications to achieve the desired thickness of this coating. If a separate bonding layer, 4, is required before application of coating, 3, it must be electrically conducting and comparable in electrical potential to either the galvanic coating or structural steel. The flame spray process allows a commercially pure grade of aluminum, aluminum alloy, or other anodic material to be applied, but other processes can be used as long as electrical contact between the anodic material and steel is maintained and the coating, 3, is firmly attached to the structure, 2. Flame spray also provides a good aluminum surface for bonding additional coating layers.

An isolation layer, 5, composed of an electrically insulating material such as a glass or ceramic is applied to the anodic coating, 3. The thickness of the coating is selected based upon the strength of the coating, the other physical and electrical properties relative to the anodic coating and structure, and the anticipated environment and loads. A more typical ceramic coating would be 2½ mils thick, but can be up to 10 mils or more. The isolation coating, 5, must completely cover the exposed portions of the anodic coating, 3.

An anti-fouling coating, 6, composed of copper-nickel alloy, is applied in a discontinuous layer to the isolation coating, 5. The discontinuous pattern and size is variable, but gaps, 7, should be relatively small. Typical gap spacing might range up to 6 inches. Since the discontinuous layer, 6, has no inherent structural strength as a complete layer, no broad shrinkage or other continuous loads are transmitted to the underlying structure, 2. A firm bonding of the discontinuous islands of copper alloy are therefore required. The thickness of the anti-fouling layer, 6, is again selected based on known or tested rates of loss for copper alloy in the underwater environment and desired life. A typical thickness for a two year life would range from ½ to 2 mils. The process of obtaining the discontinuous layer requires a masking of the surface with the mesh pattern desired. The mesh material can be steel, plastic or the anti-fouling copper alloy for easy recycling. To further protect exposed portions of the isolation coating, 5, a sealing layer, 8, can be applied.

If the integrity of the multilayer coating, 1, is destroyed by puncture, delamination or splitting the underlying steel structure, 2, may come into contact with the cathodic anti-fouling coating, 6. Galvanic current will accelerate corrosion at that point in proportion to the exposed surface of the contacted copper alloy mass. Without the discontinuity pattern, this mass would encompass the whole exposed area of the structure. A large amount of galvanic current would concentrate on the fault area, and corrosion would be greatly accelerated. Instead, the gaps created by the masking process very narrowly circumscribe the size of the electricaly active copper to the fault. The galvanic current flow is thus constrained and corrosion of the structure is limited.

Figure 2:
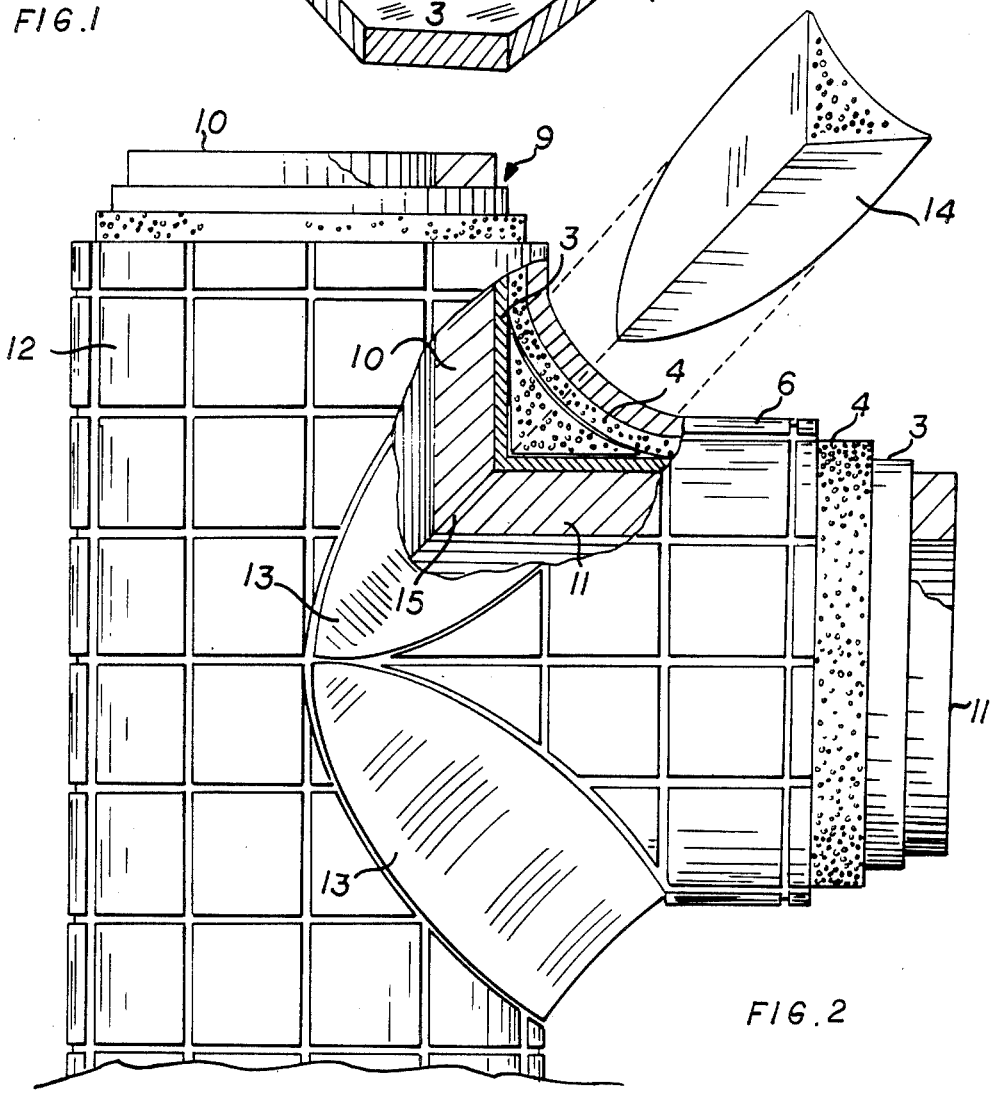
FIG. 2 is a reduced-scale view of a portion of a tubular support structure with the intermittent pattern of the exposed layer.

FIG. 2 shows portions of an underwater rod or tubular structure protected by the multilayer coating system. The portion of the structure, 9, shown is two joined steel tubes or rods, 10, 11. The grid pattern, 12, of the discontinuous anti-fouling coating, 6, covers the exposed surfaces. A built-up transition area, 13, at the joint is shown which simplifies application of the coatings, minimizes stress concentrations, and reduces surface area exposed to fouling organisms.

As illustrated in the cut-away section of the drawing, the transition area, 13, is formed by placing a crescent-shaped half-collars, 14, (one-half of one is shown in the exploded view) around the pipe joint, 15, and between the aluminum anodic layer, 3, and the insulating ceramic coating, 5. These half-collars can be built up with putty or other malleable substance.

While the preferred embodiment of the invention in various configurations has been described, other embodiments and configurations may be devised without departing from the spirit of the invention and the scope of the appended claims.

What is claimed is:

1. A series of coatings for providing protection of an underlying metal structure which comprises:

a corrosion protection layer fixed to said underlying metal structure composed of a material more anodic than said underlying metal structure;

an insulating layer composed of an impermeable electrically insulating material which fully covers and is fixed to said corrosion protection layer; and a discontinuous fouling protection layer composed of biologically fouling resistant material segments which are fixed to and cover the majority of said insulating layer.

2. The series of coatings claimed in claim 1, wherein said fouling protection layer segments has dimensions no larger than the interior spaces of a mesh masking screen.

3. The series of coatings claimed in claim 2, which further comprises:

a first bonding layer between said underlying metal structure and said corrosion protection layer; and a first sealing layer fixed to the exposed portions of said insulating layer.

4. The series of coatings claimed in claim 2, wherein said corrosion protection layer is composed primarily of aluminum.

5. The series of coatings claimed in claim 2, wherein said insulating layer is composed primarily of a ceramic insulating material.

6. The series of coatings claimed in claim 2, wherein said discontinuous fouling protection layer is composed primarily of copper.

7. The series of coatings claimed in claim 4, wherein said corrosion protection layer is from 2 to 10 mils thick.

8. The series of coatings claimed in claim 5, wherein said insulating layer is from 2 to 10 mils thick.

9. The series of coatings claimed in claim 6, wherein said fouling protection discontinuous layer is from 0.5 to 10 mils thick.

10. The series of coatings claimed in claim 9, wherein gap dimensions between said discontinuous segments of the fouling protection layer are no larger then 6 inches.

* * * * *